United States Patent [19]

Kausche

[11] 3,978,776

[45] Sept. 7, 1976

[54] CHIMNEY FOR EXHAUST GAS HAVING MEANS FOR THROTTLING A FLOW OF EXHAUST GAS

[75] Inventor: Robert Kausche, Winterthur, Switzerland

[73] Assignee: Sulzer Brothers Limited, Winterthur, Switzerland

[22] Filed: Nov. 19, 1974

[21] Appl. No.: 525,086

[30] Foreign Application Priority Data

Nov. 23, 1973 Switzerland ..... 16507/73

[52] U.S. Cl. ..... 98/58; 98/60; 98/78; 138/45

[51] Int. Cl.[2] ..... F23L 17/08

[58] Field of Search ..... 98/58, 59, 60, 78, 81, 98/84, 85 SV, 122, 83; 114/187; 138/45, 46, 178; 239/447, 541

[56] References Cited

UNITED STATES PATENTS

| | | | |
|---|---|---|---|
| 2,703,959 | 3/1955 | Wetherbee, Jr. | 138/45 X |
| 2,714,847 | 8/1955 | Svebel | 98/58 |
| 2,831,505 | 4/1958 | Menard | 138/45 |
| 3,502,308 | 3/1970 | Simizu | 138/45 X |

FOREIGN PATENTS OR APPLICATIONS

| | | | |
|---|---|---|---|
| 3,233 | 2/1894 | United Kingdom | 98/84 |

*Primary Examiner*—William F. O'Dea
*Assistant Examiner*—Harold Joyce
*Attorney, Agent, or Firm*—Kenyon & Kenyon Reilly Carr & Chapin

[57] ABSTRACT

The upper end of the chimney supports an outer upwardly converging funnel and an inner coaxial upwardly converging funnel which are movable relative to each other to open and close an auxiliary annular channel for exhaust gas flow. The drive for moving the funnels relative to each other is connected through the wall of the chimney to the inner funnel via support arms.

9 Claims, 3 Drawing Figures

CHIMNEY FOR EXHAUST GAS HAVING MEANS FOR THROTTLING A FLOW OF EXHAUST GAS

This invention relates to a chimney for exhaust gas with a means for throttling the flow of exhaust gas.

In order to protect a surrounding environment, remote heating plants are of increasing significance. This is because large-output plants can better control both the storage and the combustion of fuel than smaller heating equipment distributed among many houses. Usually, such remote central heating plants have to be enlarged in the course of time because the territory served increases. The range of performance of a plant moreover varies through a year so that the plant operates with a lower performance in summer than in winter. Thus, the quantities of exhaust or waste gas from a central heating plant vary in an annual rhythm, as well as in the course of a number of years. If for architectural or economic reasons a central heating plant is provided with only a single exhaust gas chimney, which is dimensioned with a view to later enlargements for the then maximum load, a problem exists in that, particularly during summer operation, the exhaust gas emerges out of the chimney at a very low speed. In unfavorable weather, this can lead to considerable local emissions.

In order to eliminate this problem, it has been known to dispose a rectangular throttling flap in the region of the outlet from the chimney. Such flaps, however, have the drawback that the outlet cross-section is angular. Consequently, the flow of exhuast gas becomes disturbed in the edge zones. This, in turn, leads to a decrease of the dynamic superelevation of the gas.

Accordingly, it is an object of the invention to improve an exhaust-gas chimney of the aforesaid kind in such a way that the flow of exhaust gas in every setting of the throttling means leaves the chimney outlet through a round cross-section.

It is another object of the invention to provide an exhaust gas chimney capable of being adapted to varying loads.

Briefly, the invention provides an exhaust gas chimney having an outlet end, an upwardly converging outflow funnel at the outlet end having an outlet of predetermined size for passage of a flow of exhaust gas and means within the funnel for throttling the flow of exhaust gas while maintaining the flow in a round cross-section. This means includes a second upwardly converging outflow funnel coaxially within the first funnel and means for moving the funnels relative to each other for throttling a flow of exhuast gas between the funnels. The two funnels are movable relative to each other into a closed position wherein the funnels adjoin each other to form an outlet of a size smaller than the outlet of the outflow funnel.

With provision of the throttling means, an annular channel is ensured for any position of the movable funnel. Thus, a round cross-section is always obtained for the stream of exhuast gas. The arrangement furthermore permits the movable funnel to stand in intermediate positions, so that an infinitely-variable adaptation of the outlet cross-section to the quantity of exhaust gas can be obtained. Thus, the stream of exhaust gas can, at a low load, be made to flow at higher speed out of the chimney.

In one embodiment, the form and size of the funnels, relative to the diameter at the top of the chimney and the travel of the movable funnel, are chosen so that even in the entirely open position of the movable funnel, the annular channel between outlet funnels converges upwardly. In this way it is ensured that the exhaust gas, after passing the lower end of the movable funnel, flows through no cross-sectional enlargements between the two funnels that might lead to detachments of the gas flow.

These and other objects and advantages of the invention will become more apparent from the following detailed description and appended claims taken in conjunction with the accompanying drawings in which:

Figure 1:
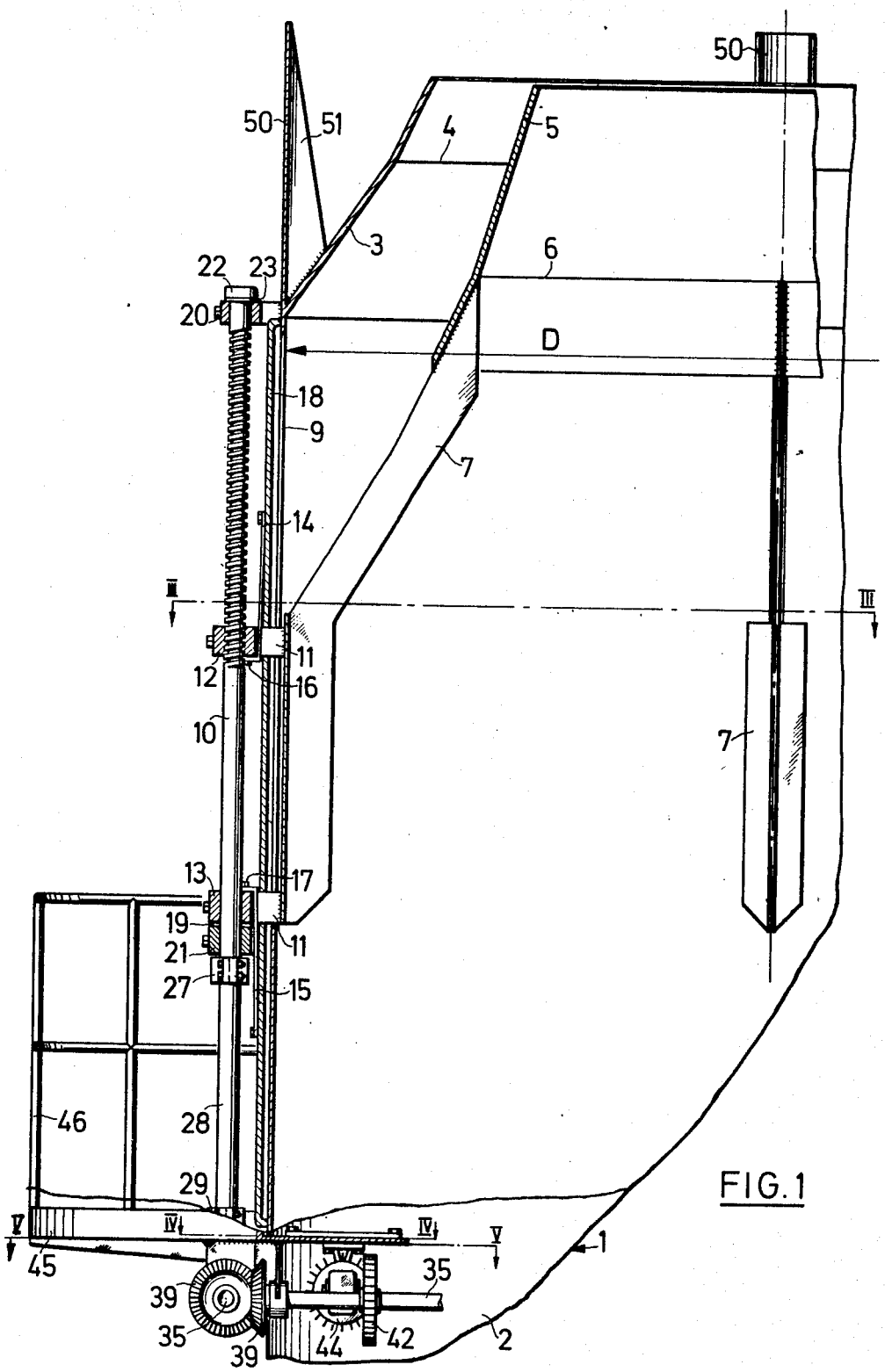
FIG. 1 illustrates a partial vertical section through the upper end of a chimney according to the invention along section planes corresponding to the lines I-I and II-II of FIG. 2.
Figure 3:
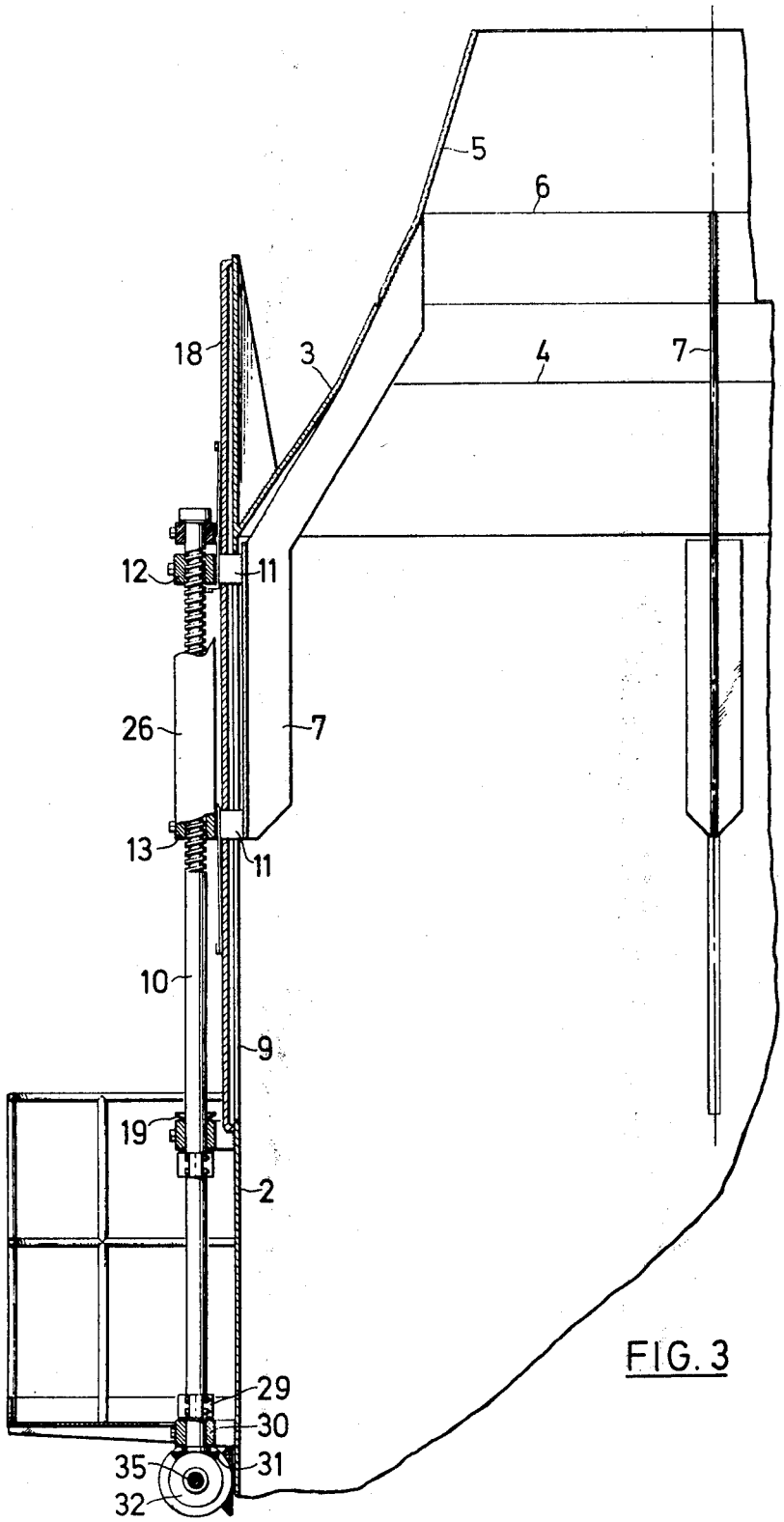
FIG. 3 illustrates a vertical partial section along the line I—I of FIG. 2.

Referring to FIG. 1, the chimney 1 consists of a vertical circular-cylindrical sheet-metal tube 2, which is provided at the upper end with an outlet funnel 3 which converges upwardly. The surface line of the outlet funnel 3 is slightly broken at an intermediate edge 4. A throttling means for throttling the flow of gas through the funnel 3 includes an axially movable funnel 5 coaxially within the outlet funnel 3. The inner funnel 5 is of smaller diameter than the outlet funnel 3 and likewise converges upwardly. The surface line of the movable funnel 5 is slightly broken at an intermediate edge 6. The maximum outer diameter of the movable funnel 5 is approximately the same as the minimum inner diameter of the outlet funnel 3, so that the lower end of the movable funnel 5 directly adjoins the upper end of the outlet funnel 3 when the movable funnel 5 assumes an uppermost position (FIG. 3).

The form and size of the outlet funnel 3 and of the movable funnel 5 are, relative to the diameter D at the top of the chimney-tube 2 as well as to the travel of the movable funnel 5, chosen so that in the lowermost position of the movable funnel 5 the annular channel between the funnels 3, 5 and between the funnel 5 and chimney tube 2 converges upwardly.

The throttling means also includes means for moving the inner funnel 5 relative to the outlet funnel 3. This latter means includes four obtuse-angled support-arms 7 which carry the funnel 5 and which are distributed uniformly round the circumference of the chimney. The upper leg of each support-arm 7 forms a web of rectangular cross-section, which is welded to the inside of the movable funnel 5. The lower leg of each support-arm 7 is T-shaped in cross-section so that the flange of the T-section is adjacent to the inside of the chimney-tube 2. The upper and lower ends of each support-arm 7 are, in each case, provided with a flat-iron section 11, which extends through a vertical slot 9 in the wall of the chimney-tube 2. These arms 7 are connected to a drive for moving the funnel 5. To this end, the drive includes screw threaded spindles 10 which each receive a split screw-threaded nut 12 secured to the upper flat-iron section 11 outside the chimney-tube 2. The lower flat-iron section 11 also has a split bearing 13 screwed on outside the chimney tube 2 which takes the screw-threaded spindle 10. Flat steel springs 14, 15 are fastened via screws 16, 17 to the nut 12 and the bearing 13 respectively. As shown, the springs 14, 15 are bent at approximately right-angles and carry a long shell-like seal 18, which extends over the entire length of the slot 9, and also a length corresponding to the travel of the movable funnel 5. The seal 18 is pressed against the outer surface of the chimney-tube 2 by means of the springs 14, 15 so that no exhaust gas can escape through the slot 9. The halves of the nut 12 fastened to the sections 11 and those of the bearing 13 are connected by flat-irons 26 as by welding (FIGS. 2 and 3).

Each screw-threaded spindle 10 is piloted in two split bearings 20, 21 fastened to the outside of the chimney-tube 2 so that an unobstructed space is left between the bearings 20, 21 and the chimney-tube 2 through which the seals 18 can move. The upper end 22 of each spindle 10 is made thicker, and supports itself by this thickened end 22 on a washer 23 made of a synthetic material requiring no lubrication, e.g. Teflon (registered trademark) upon the upper bearing 20. A Belleville washer 19 is installed on the lower bearng 21 upon which the movable bearing 13 is supported when the movable funnel 5 is in a lowermost position. The lower end of each spindle 10 is connected with a shaft stub-end 28 by an axially-movable coupling 27 which, via a split-sleeve 29, is supported on a bottom bearing 30 (FIG. 3) fastened to the outside of the chimney-tube 2. The shaft stub-end 28 below this bottom bearing 30 carries a bevel-wheel 31 which meshes with a bevel-wheel 32 installed on a horizontal shaft 35. Thus, four horizontal shafts 35 are provided around the chimney-wall and are interconnected together at their adjacent ends by pairs of meshing bevel-wheels 39.

Figure 2:
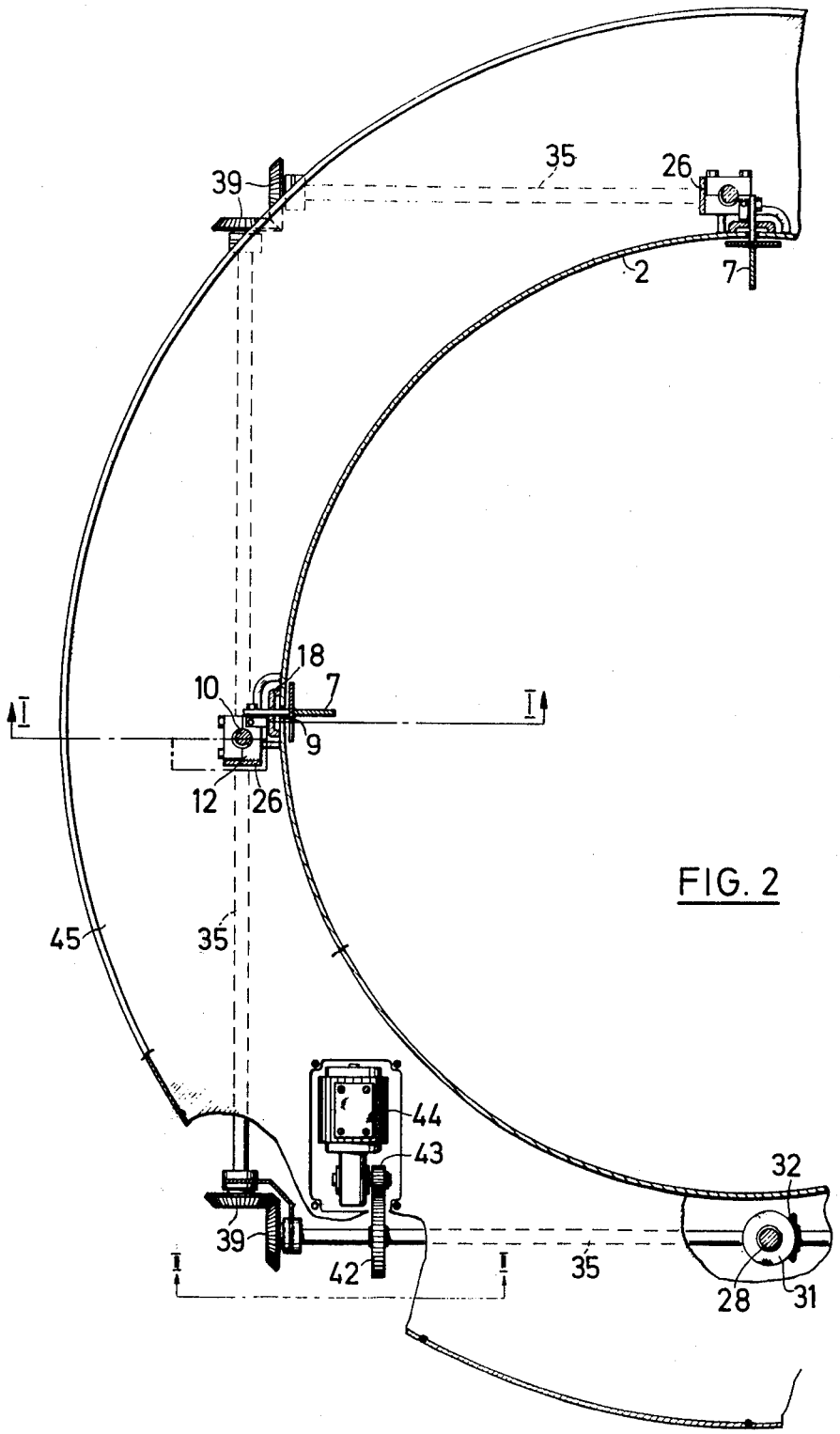
FIG. 2 illustrates a horizontal partial sectional view along section planes corresponding to the lines III-III, IV—IV and V—V of FIG. 1.

As shown in FIGS. 1 and 2, one of the horizontal shafts 35 is provided with a gearwheel 42, which engages with a pinion 43 of an electric drive-motor 44, whose direction of rotation can be reversed. This drive-motor 44 is fastened on a platform 45, provided with a railing 46, which surrounds the outside of the chimney-tube. The bearings for the four shafts 35 are also fastened on this platform 45. In order to service and inspect these bearings, the platform 45 has sections (not shown) that can be swung up.

In each extension of the slot 9 there is disposed, above the chimney-tube 2, a U-shaped bracket 50 having upwardly directed legs 51. Each bracket 50 is positioned to permit the seals 18 to slide thereon during the movement of the movable funnel 5.

The described arrangement works as follows: Under full load of the boilers connected with the exhaust-gas chimney, the movable funnel 5, as shown in FIG. 1, is in an lowermost position. In this position, the four bearings 13 rest on the Belleville washers 19. When the load on the boilers decreases, then the drive-motor 44 is switched into the "upward" direction, whereupon the four screw-threaded spindles 10 are driven in the same direction and at the same speed. The support-arms 7, and thus the movable funnel 5, are thus moved upward through the intermediary of the four screw-threaded nuts 12. At the same time, the four seals 18 are moved upwardly. Depending on the magnitude of the decrease of load, the movable funnel 5 assumes an intermediate position, or in the case of minimum load, arrives at an uppermost position, as shown in FIG. 3.

It is also possible to select the dimensions of the outflow funnel 3 and of the movable funnel 5 so that the convergence of the annular channel between the funnels 3, 5 is less than that of the channel surrounded by the movable funnel 5.

It is also possible for the chimney-tube 2 to have a slightly tapered form with the major diameter located at the lower end.

It is also possible to mount the smaller funnel 5 in a stationary manner on the chimney-tube 2 and to make the outlet funnel 3 axially movable. In that case, the two funnels adjoin when the larger funnel is in a lowermost position.

What is claimed is:

1. An exhaust gas chimney having an outlet end, a first upwardly conveying outflow funnel at said outlet and having an outlet of predetermined size for passage of a flow of exhaust gas therethrough, a second upwardly converging funnel coaxially within said first funnel of smaller size than said first funnel, and means for moving said funnels relative to each other for throttling a flow of exhaust gas between said funnels, said funnels being movable into a closed position relative to each other wherein said funnels adjoin each other to form an outlet of a size smaller than said outlet of said first funnel.

2. An exhaust gas chimney as set forth in claim 1 wherein said funnels define an upwardly converging annular channel therebetween in a fully open position relative to each other.

3. An exhaust gas chimney as set forth in claim 2 wherein said second funnel defines an internal upwardly converging passage for the flow of an exhaust gas and wherein said annular channel converges in an upward directon at a lesser rate than said internal passage.

4. An exhaust gas chimney as set forth in claim 1 wherein said means for moving said funnels includes a plurality of support arms connected to said second funnel and disposed circumferentially of said chimney, and a drive connected to said arms for moving said second funnel relative to said first funnel.

5. An exhaust gas chimney as set forth in claim 4 wherein said drive includes a reversible motor for moving said second funnel in opposite directions.

6. An exhaust gas chimney as set forth in claim 4 which further has a peripheral wall supporting said first funnel thereon and wherein said wall includes a plurality of elongated vertical slots therein and each arm passes through a respective slot and wherein said drive includes a plurality of screw-threaded spindles, each spindle being connected to a respective arm for moving said arm vertically upon rotation of said spindle.

7. An exhaust gas chimney as set forth in claim 6 wherein said drive includes a plurality of horizontal shafts about said chimney wall, bevel gears interconnecting said shafts to each other and to said spindles and a motor connected to at least one of said shafts for driving said shafts and spindles.

8. An exhaust gas chimney as set forth in claim 6 which further has a plurality of seals, each seal being mounted over a respective slot to seal said slot to the exterior of said wall.

9. An exhaust gas chimney having an outlet end, an upwardly converging outflow funnel at said outlet end for passage of a flow of exhaust gas, said outflow funnel having a minimum inner diameter at an upper end, a second upwardly converging funnel coaxially within said outflow funnel for throttling the flow of exhaust gas while maintaining the flow in a round cross-section, said second funnel having a maximum outer diameter at a lower end approximately the same as said minimum inner diameter of said outflow funnel and means for moving said funnels vertically relative to each other from a closed position to an open position to define an annular chamber between said funnels for a flow of exhaust gas.

* * * * *